US006826836B1

(12) United States Patent
Lin

(10) Patent No.: US 6,826,836 B1
(45) Date of Patent: Dec. 7, 2004

(54) SAFETY CLASP KNIFE

(76) Inventor: Paul Lin, 4F, No. 102, Sec. 1, Roosevelt Rd., Taipei (TW)

( * ) Notice: Subject to any disclaimer, the term of this patent is extended or adjusted under 35 U.S.C. 154(b) by 0 days.

(21) Appl. No.: 10/716,112

(22) Filed: Nov. 18, 2003

(51) Int. Cl.[7] ..... B26B 1/04
(52) U.S. Cl. ..... 30/161; 30/155
(58) Field of Search ..... 30/158, 160, 161, 30/155

(56) References Cited

U.S. PATENT DOCUMENTS 4,170,061 A * 10/1979 Henry ..... 30/160
4,272,887 A * 6/1981 Poehlmann ..... 30/161
4,893,409 A * 1/1990 Poehlmann ..... 30/161
5,331,741 A * 7/1994 Taylor, Jr. ..... 30/158
5,964,035 A * 10/1999 Poehlmann ..... 30/161
6,079,106 A * 6/2000 Vallotton ..... 30/161
6,574,869 B1 * 6/2003 McHenry et al. ..... 30/161

* cited by examiner

*Primary Examiner*—Hwei-Siu Payer
(74) *Attorney, Agent, or Firm*—William E. Pelton, Esq.

(57) ABSTRACT

A safety clasp knife is composed of a blade pivotally received in the handle including a top cover and a bottom cover. The blade is defined with a through hole, a first limiting notch in communication with the through hole and a second limiting notch in communication with the through hole and opposite to the first limiting notch such that a spring-driven positioning rod which is movably received in the handle is able to alternatively be received and limited in the first limiting notch and the second limiting notch to allow the blade to extend out of the handle or be received in the handle.

15 Claims, 6 Drawing Sheets

SAFETY CLASP KNIFE

BACKGROUND OF THE INVENTION

1. Field of the Invention

The present invention relates to a safety clasp knife, and more particularly to the clasp knife having a positioning rod movably mounted in the handle to allow the positioning rod to be alternatively fixed relative to the blade such that the blade is able to be foldable relative to the handle.

2. Description of Related Art

With reference to FIGS. 7 and 8, a conventional clasp knife includes a handle (80) and a blade (90).

The handle (80) has a receiving space (81) defined in the handle (80) to alternatively receive therein the blade (90), a stop (82) formed on a side face of the handle (80), and a position slot (84) defined through the handle (80).

The blade (90) has a boss (91) formed on a distal end of the blade (90) to be received in the position slot (84) of the handle (80) and a spring (92) having a first distal end abutted in an inner face of the handle (80) and a second distal end abutted to the boss (91).

The blade (90) is pivotally received in the handle (80) with the spring (92) being compressed by the boss (91). However, when the blade (90) is extended out of the handle (80), due to the abutment of the spring (92) to the boss (91), the boss (91) is able to move within the position slot (84) from a first position to a second position until the blade (90) is fully extended.

When the blade (90) is folded, the operator has to push the blade (90) toward the handle (80) first to allow the boss (91) to leave the second position to compress the spring (92). After the boss (91) leaves the limitation of the second position, the blade (90) is able to be pivoted and received inside the receiving space (81) of the handle (80).

When the clasp knife is operated, in order to allow the operator to operate the pivotal movement of the blade (90), the blade (90) has a large portion revealed outside, which spoils the overall appearance. Furthermore, after a long period of time using the clasp knife, the periphery of the position slot may become worn and thus the boss may not be limited by the position slot. Accordingly, the blade (90) may be pivoted relative to the handle (80) even when the blade (90) is not moved toward the handle (80) first to release the limitation of the position slot (84) to the boss (91), which is very dangerous to the operator and is a design flaw.

The spring is also exposed outside the handle such that the spring escapes easily from the knife.

Due to the formation of the boss and the adaptation made to the blade to cope with the spring, the appearance of the clasp knife does not have much room for change and improvement.

To overcome the shortcomings, the present invention tends to provide an improved safety clasp knife to mitigate the aforementioned problems.

SUMMARY OF THE INVENTION

The primary objective of the present invention is to provide an improved safety clasp knife having a blade pivotable relative to the handle. The handle has a positioning rod movably received in the handle such that the positioning rod is able to alternatively move from a first position to a second position or from the first position to a third position in the blade to allow the blade to pivot relative to the handle.

In order to accomplish the above objective, the blade is composed with a through hole, a first limiting notch defined in a periphery defining the through hole and a second limiting notch defined in a periphery defined the through hole and opposite to the first limiting notch. Therefore, the positioning rod received in the through hole of the blade is able to move to the first limiting notch or the second limiting notch due to the drive of the springs especially when the blade is fully extended outside the handle or fully received in the handle.

Other objects, advantages and novel features of the invention will become more apparent from the following detailed description when taken in conjunction with the accompanying drawings.

DETAILED DESCRIPTION OF THE PREFERRED EMBODIMENT

Figure 1:
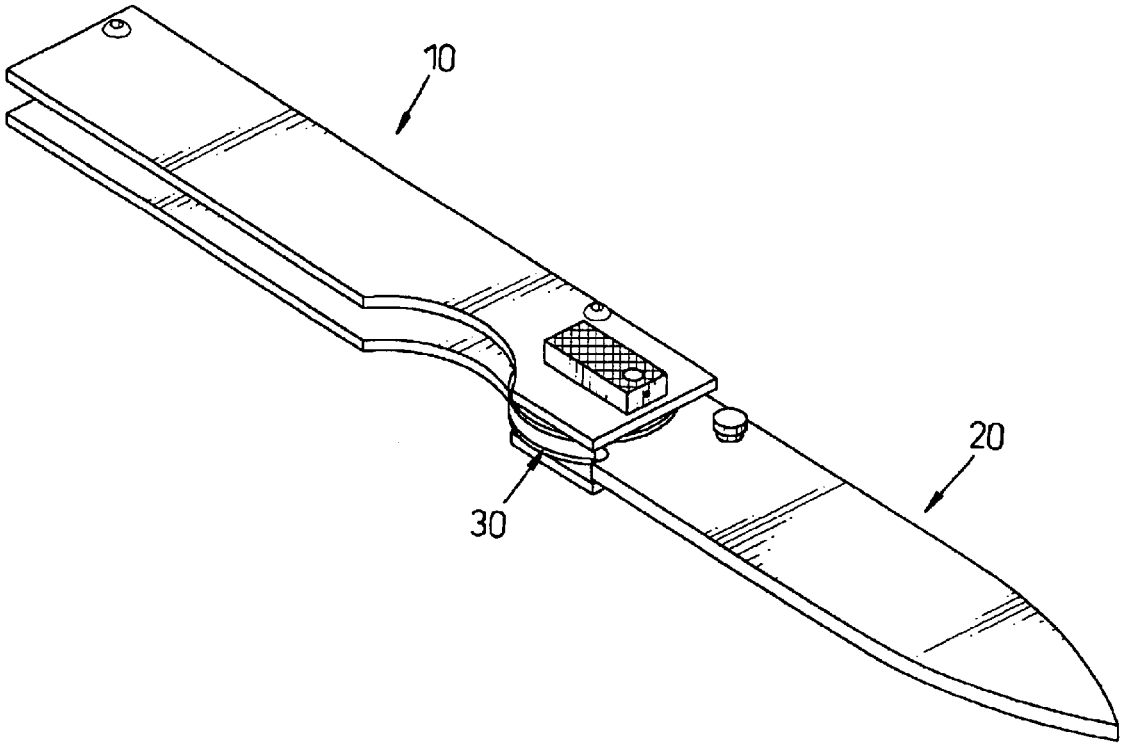
FIG. 1 is perspective view of the clasp knife of the present invention.
Figure 2:
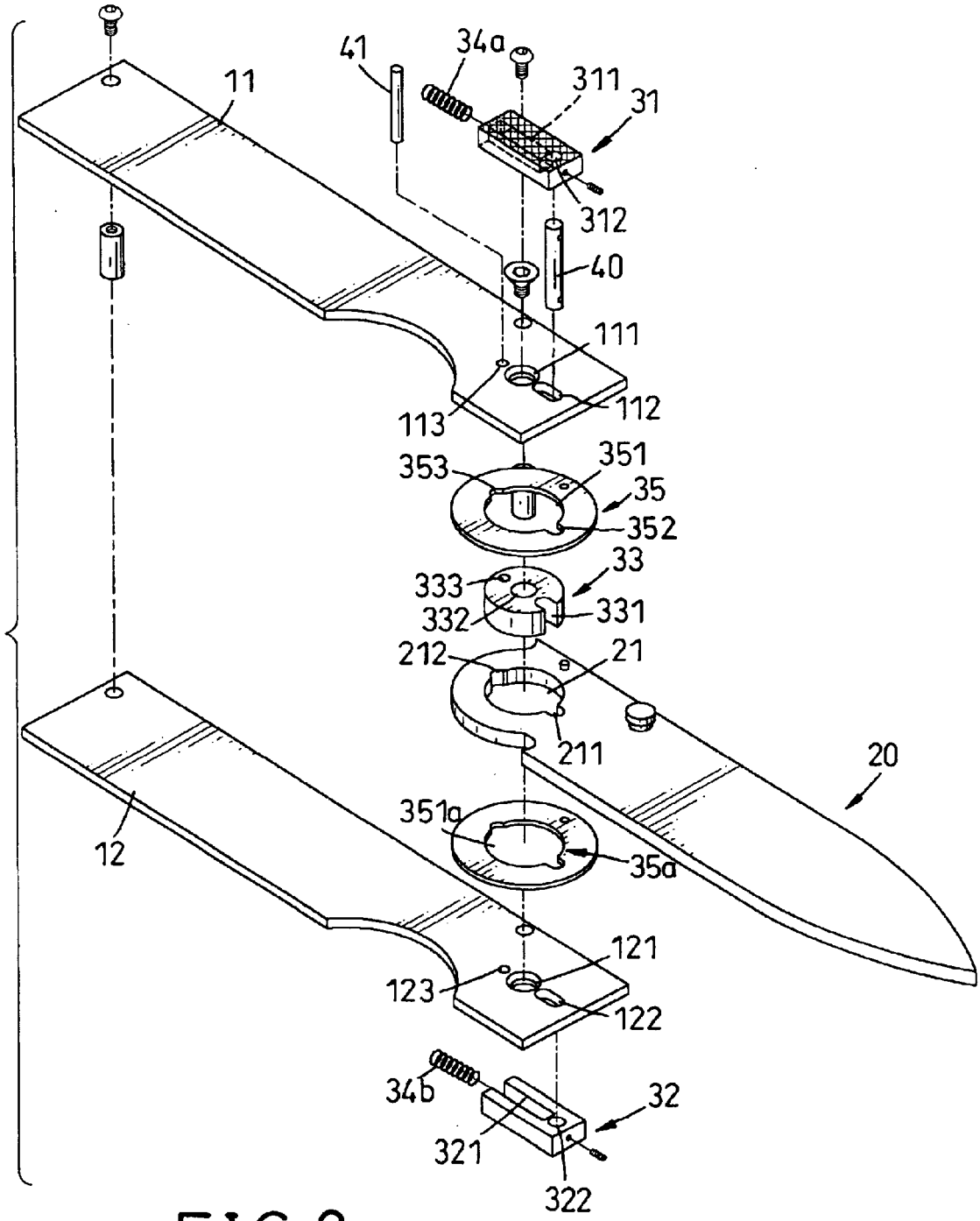
FIG. 2 is an exploded perspective view of the clasp knife of the present invention in FIG. 1.

With reference to FIG. 1, it is noted that the clasp knife in accordance with the present invention has a handle (10), a blade (20) and a positioning device (30).

The handle (10) is composed of a top cover (11) and a bottom cover (12) together with the top cover (11) to form the handle (10). The top cover (11) has a first top securing hole (111), a first long hole (112) defined adjacent to the first top securing hole (111) and a second top securing hole (113) defined opposite relative to the first long hole (112). The bottom cover (12) has a first bottom securing hole (121), a second long hole (122) defined adjacent to the first bottom securing hole (121) and a second bottom securing hole (123) defined opposite relative to the second long hole (122).

The blade (20) has a through hole (21), a first limiting notch (211) defined in a periphery defining the through hole (21) and a second limiting notch (212) also defined in the periphery defining the through hole (21) of the blade (20) and opposite to the first limiting notch (211).

The positioning device (30) has a top positioning plate (31), a bottom positioning plate (32), a limiting disk (33), a top spring **(34*a*), a bottom spring (34*b*), a first spacer (35) and a second spacer (35*a*). The top positioning plate (31) has a first groove (311) defined in a bottom face of the top positioning plate (31) to receive therein the top spring (34*a*) and a first aperture (312) defined adjacent to the first groove (311). The bottom positioning plate (32) has a second groove (321) defined in a top face of the bottom positioning plate (32) to receive therein the bottom spring (34***b*) and a second aperture (322) defined adjacent to the second groove (321). The limiting disk (33) has a cutout (331) corresponding to the first aperture (312) and the second aperture (322), a hole (332) in communication with the first top securing hole (111) of the top cover (11), the through hole (21) of the blade (20) and the first bottom securing hole (121) of the bottom cover (12), and an orifice (333) in communication with the second top securing hole (113) of the top cover (11), and the second bottom securing hole (123) of the bottom cover (12). The first spacer (35) is sandwiched between the limiting disk (33) and the top cover (11) to reduce the friction therebetween and has an extension hole (351) in communication with the first top securing hole (111), the hole (332) and the through hole (21), a first indent (352) in communication with the first long hole (112), the cutout (331) and the first limiting notch (211), and a second indent (353) in communication with the second limiting notch (212). The second spacer (35*a*) has a structure and function the same as that of the first spacer (35) such that detailed description of the second spacer (35*a*) is omitted for brevity. A positioning rod (40) is provided to extend through the first long hole (112), the extension hole (351), the through hole (21), the extension hole (351*a*) and into the second hole (122). A pivot rod (41) is provided to extend through the second top securing hole (113), the extension hole (351), the orifice (333), the extension hole (351*a*) and into the second bottom securing hole (123).

With reference to FIGS. 3, 4, 5 and 6, it is noted that when the clasp knife of the present invention is to be assembled, a rivet (not numbered), a bolt and nut combination or the like may be applied to extend through the top positioning plate (31), the first top securing hole (111) of the top cover (11), the extension hole (351) of the first spacer (35), the hole (332) of the limiting disk (33), the extension hole (351*a*) of the second spacer (35*a*), the first bottom securing hole and into the bottom positioning plate (32). Then the rivet is deformed to allow that the top positioning plate (31) and the bottom positioning plate (32) are able to directly and smoothly engage with the top cover (11) and the bottom cover (12) respectively and that the first spacer (35), the limiting disk (33), the blade (20), the second spacer (35*a*) are securely sandwiched between the top cover (11) and the bottom cover (12). However, before the first spacer (35), the limiting disk (33), the blade (20), the second spacer (35*a*) are securely sandwiched between the top cover (11) and the bottom cover (12), the positioning rod (40) is extended through the first aperture (312), the first long hole (112), the extension hole (351) of the first spacer (35*a*), the through hole (21) of the blade (20), the extension hole (351*a*) of the second spacer (35*a*), the second long hole (122) of the bottom cover (12) and into the second aperture (322) of the bottom positioning plate (32). Meanwhile, the pivot rod (41) is extended through the second top securing hole (113), the extension hole (351) of the first spacer (35), the orifice (333) of the limiting disk (33), the through hole (21) of the blade (20), the extension hole (351*a*) of the second spacer (35*a*) and then riveted in the second bottom securing hole (123) of the bottom cover (12). The top spring (34*a*) is received in the first groove (311) and sandwiched between the positioning rod (40) and the pivot rod (41). The bottom spring (34*b*) is received in the second groove (321) and also sandwiched between the positioning rod (40) and the pivot rod (41). Thus the assembly of the clasp knife of the present invention is completed.

Figure 3:
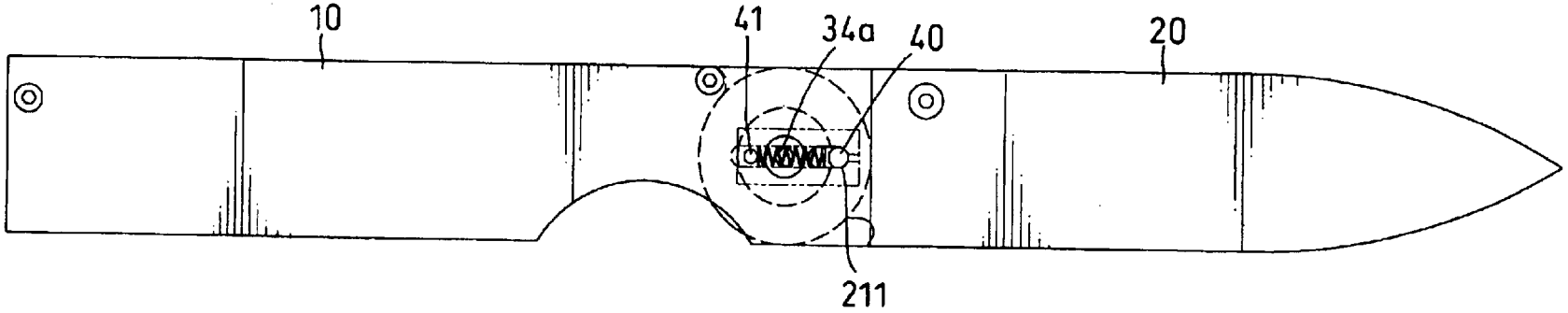
FIG. 3 is a schematic view showing that the positioning rod is pushed by the spring to move to the free end of the blade when the blade is extended out of the handle.
Figure 4:
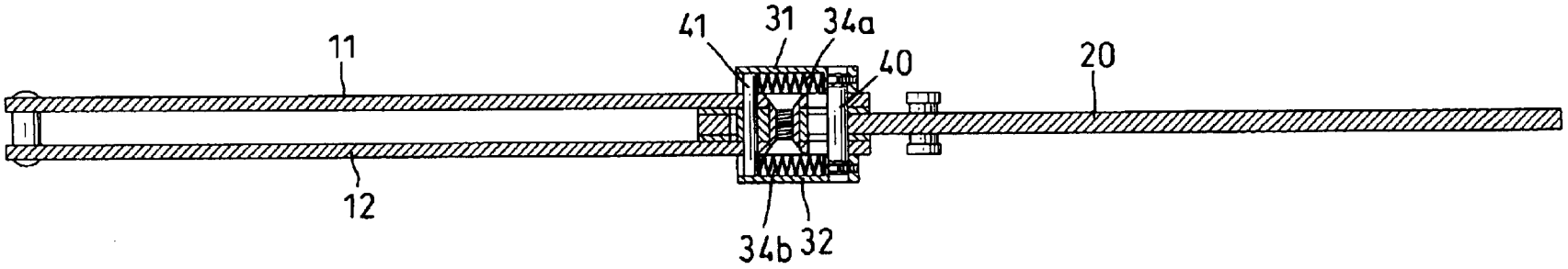
FIG. 4 is a cross sectional view showing that the positioning rod is pushed by the springs to move to the free end of the blade.

It can be seen from FIGS. 3 and 4 that when the blade (20) is fully extended out of the handle (10) and horizontal to the handle (10), the positioning rod (40) pushed by the top spring (34*a*) and the bottom spring (34*b*) is received and limited by the first limiting notch (211) of the blade (20) such that the blade (20) is not able to be pivoted relative to the handle (20). However, when the blade (20) is to be folded and received in the handle (20), the operator is able to simultaneously push the top positioning plate (31) and the bottom positioning plate (32) to use the positioning rod (40) and the pivot rod (41) to compress the top and bottom springs (34*a*,34*b*). Thus the positioning rod (40) is moved in the first long hole (112) and the second long hole (122), which allows the positioning rod (40) to be released from the limitation of the first limiting notch (211) and the blade (20) is able to be pivoted relative to the handle (20). It is noted that after the top and bottom springs (34*a*,34*b*) are compressed to allow the positioning rod (40) to move, the positioning rod (40) is moved into the cutout (331) of the limiting disk (33). Then after the pivotal movement of the blade (20), the positioning rod (40) is limited by a periphery defining the first long hole (112) of the top cover (11) and the second long hole (122) of the bottom cover (12). Because there is no solid support to the blade (20), therefore, there is no worry that the blade (20) may cause any kind of damage especially when the blade (20) is in its pivotal movement.

Figure 5:
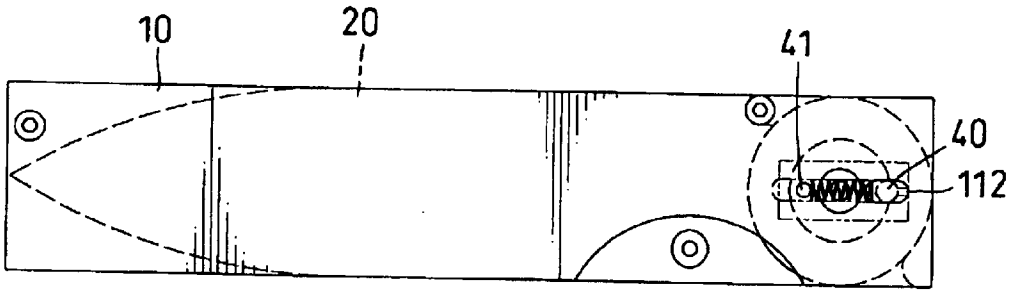
FIG. 5 is a schematic view showing that the positioning rod is pushed by the spring to be received in the handle.
Figure 6:
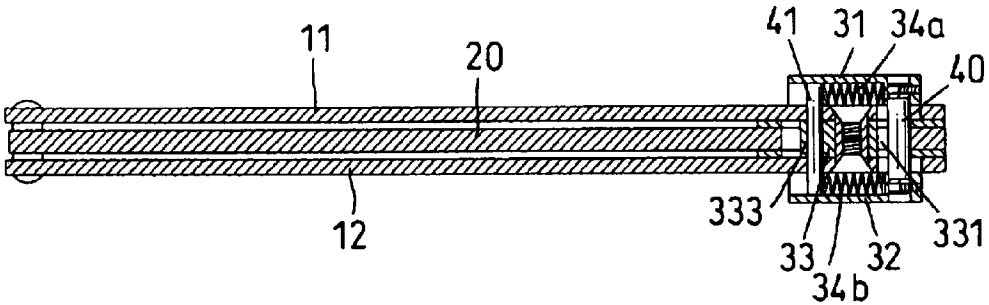
FIG. 6 is a cross sectional view showing that the blade is pushed by the springs to move to the second limiting notch in the blade when the blade is received in the handle.
Figure 7:
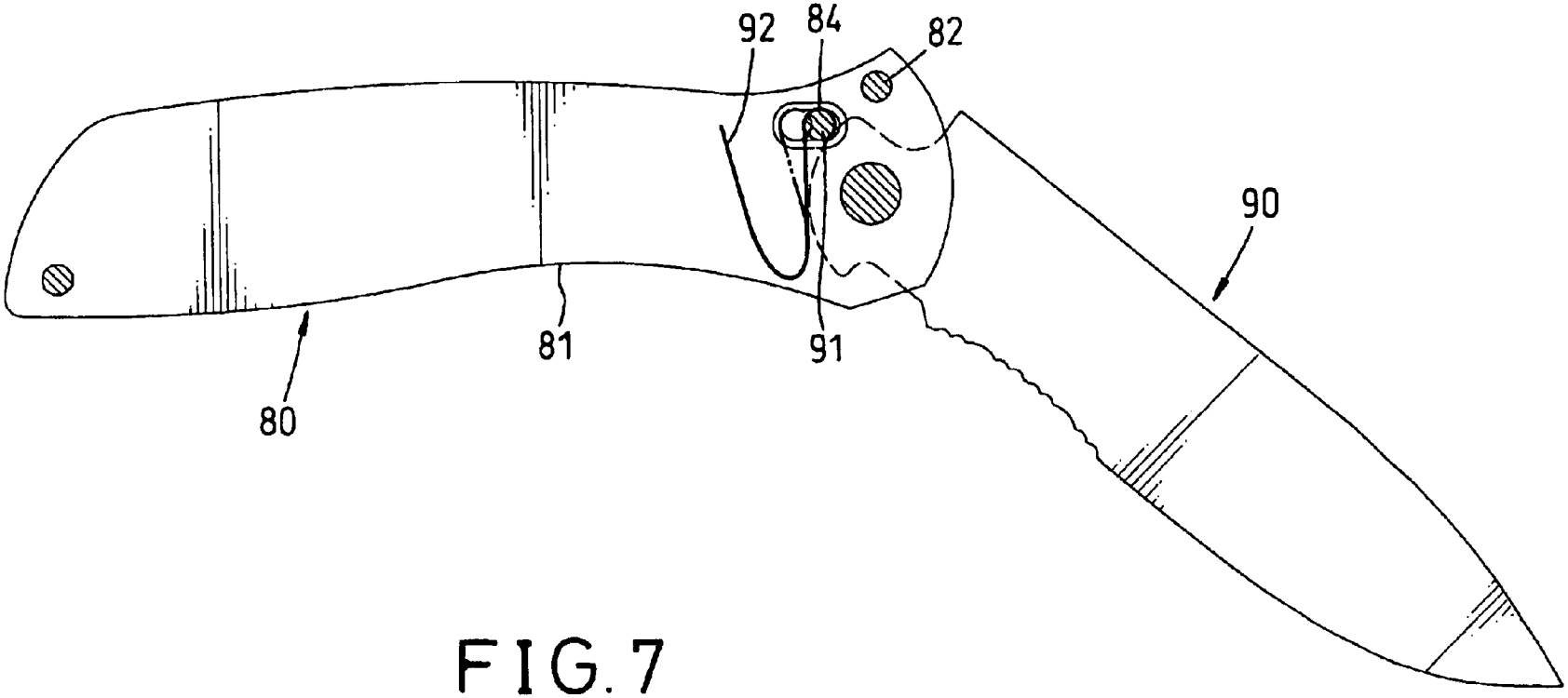
FIG. 7 PRIOR ART
FIG. 7 is a schematic plan view of a conventional clasp knife.
Figure 8:
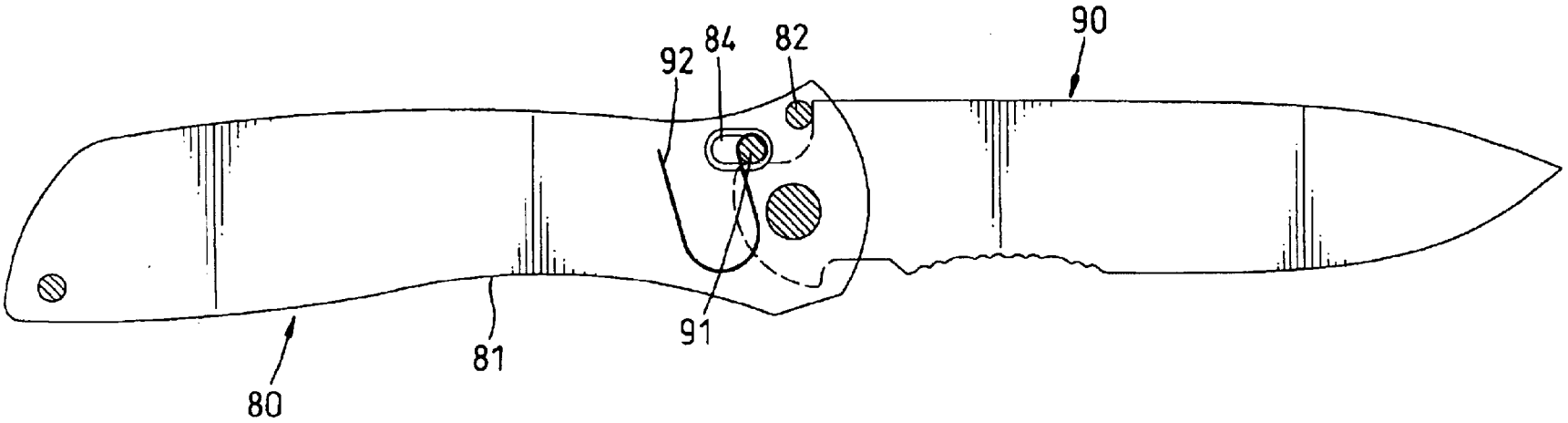
FIG. 8 PRIOR ART
FIG. 8 is a schematic plan view showing that the blade is pivoted relative to the handle.

When the blade (20) is fully received in the handle (10), it can be seen from FIGS. 5 and 6 that after the blade (20) is pivoted relative to the handle (20), the second limiting notch (212) is aligned with the positioning rod (40). Accordingly, due to the recovering force of the top and bottom springs (34*a*,34*b*) from the previous pivotal movement of the blade (20) to be received in the handle (10), the positioning rod (40) is again driven to move and received in the second limiting notch (212), which accomplishes the folding operation of the blade (20).

To extend the blade, it is also required to push the top positioning plate (31) and the bottom positioning plate (32) to withdraw the positioning rod (40) into the through hole (21) of the blade (20) and the cutout (331) of the limiting disk (33) such that the blade (20) is able to be pivoted relative to the handle (10). After the blade (20) becomes pivotal, the extension of the blade (20) is the same as that disclosed earlier and thus detailed operation thereof is omitted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A safety clasp knife comprising:

a handle composed of:

a top cover having a first long hole; and a bottom cover securely engaged with the top cover and having a second long hole;

a blade pivotal relative to and alternatively received in the handle, wherein the blade is sandwiched between the top cover and the bottom cover and having a through hole defined in a first distal end of the blade, a first limiting notch defined in a periphery defining the through hole and a second limiting notch defined in the periphery defining the through hole to be opposite to the first limiting notch; and a spring driven positioning rod extending through the first long hole, the through hole and the second long hole to be movable in the first and second long holes such that when the blade is to be fully extended relative to the handle and the first limiting notch is in communication with the first and second long holes, the positioning rod is received in the first limiting notch of the blade to fix the blade relative to the handle and when the blade is to be received in the handle and the second limiting notch is in communication with the first and second long holes, the positioning rod is received in the second limiting notch of the blade to fix the blade relative to the handle.

2. The safety clasp knife as claimed in claim 1 further comprising a limiting disk received in the through hole of the blade and sandwiched between the top cover and the bottom cover, the limiting disk having a cutout defined in a peripheral edge of the limiting disk to alternatively align with the first limiting notch and the second limiting notch such that when the positioning rod is moved away from the first limiting notch, the positioning rod is received in the cutout and when the positioning rod is moved away from the second limiting notch, the positioning rod is received in the cutout.

3. The safety clasp knife as claimed in claim 1 further comprising a top positioning plate having a first aperture defined in a bottom face of the top positioning plate to receive therein a first distal end of the positioning rod and a first groove defined in the bottom face of the top positioning plate to receive therein a first spring and a bottom positioning plate having a second aperture defined in a top face of the bottom positioning plate to receive therein a second distal end of the positioning rod and a second groove defined in the top face of the bottom positioning plate to receive therein a second spring.

4. The safety clasp knife as claimed in claim 2 further comprising a top positioning plate having a first aperture defined in a bottom face of the top positioning plate to receive therein a first distal end of the positioning rod and a first groove defined in the bottom face of the top positioning plate to receive therein a first spring and a bottom positioning plate having a second aperture defined in a top face of the bottom positioning plate to receive therein a second distal end of the positioning rod and a second groove defined in the top face of the bottom positioning plate to receive therein a second spring.

5. The safety clasp knife as claimed in claim 4, wherein a pivot rod is provided to extend through the top cover, the limiting disk, the through hole of the blade, the bottom cover and into the bottom positioning plate such that the first spring and the second spring are sandwiched between the positioning rod and the pivot rod.

6. The safety clasp knife as claimed in claim 1 further comprising a first spacer sandwiched between the top cover and the blade and having an extension hole in communication with the through hole of the blade and a first indent defined in a periphery defining the extension hole to be in communication with the first limiting notch and a second indent defined in the periphery defining the extension hole to be opposite to the first indent and in communication with the second limiting notch.

7. The safety clasp knife as claimed in claim 2 further comprising a first spacer sandwiched between the top cover and the blade and having an extension hole in communication with the through hole of the blade and a first indent defined in a periphery defining the extension hole to be in communication with the first limiting notch and a second indent defined in the periphery defining the extension hole to be opposite to the first indent and in communication with the second limiting notch.

8. The safety clasp knife as claimed in claim 3 further comprising a first spacer sandwiched between the top cover and the blade and having an extension hole in communication with the through hole of the blade and a first indent defined in a periphery defining the extension hole to be in communication with the first limiting notch and a second indent defined in the periphery defining the extension hole to be opposite to the first indent and in communication with the second limiting notch.

9. The safety clasp knife as claimed in claim 4 further comprising a first spacer sandwiched between the top cover and the blade and having an extension hole in communication with the through hole of the blade and a first indent defined in a periphery defining the extension hole to be in communication with the first limiting notch and a second indent defined in the periphery defining the extension hole to be opposite to the first indent and in communication with the second limiting notch.

10. The safety clasp knife as claimed in claim 5 further comprising a first spacer sandwiched between the top cover and the blade and having an extension hole in communication with the through hole of the blade and a first indent defined in a periphery defining the extension hole to be in communication with the first limiting notch and a second indent defined in the periphery defining the extension hole to be opposite to the first indent and in communication with the second limiting notch.

11. The safety clasp knife as claimed in claim 6 further comprising a second spacer sandwiched between the bottom cover and the blade and having a second extension hole in communication with the through hole of the blade, a third indent defined in a periphery defining the second extension hole to be in communication with the first limiting notch and a fourth indent defined in the periphery defining the second extension hole to be in communication with the second limiting notch.

12. The safety clasp knife as claimed in claim 7 further comprising a second spacer sandwiched between the bottom cover and the blade and having a second extension hole in communication with the through hole of the blade, a third indent defined in a periphery defining the second extension hole to be in communication with the first limiting notch and a fourth indent defined in the periphery defining the second extension hole to be in communication with the second limiting notch.

13. The safety clasp knife as claimed in claim 8 further comprising a second spacer sandwiched between the bottom cover and the blade and having a second extension hole in communication with the through hole of the blade, a third indent defined in a periphery defining the second extension hole to be in communication with the first limiting notch and a fourth indent defined in the periphery defining the second extension hole to be in communication with the second limiting notch.

14. The safety clasp knife as claimed in claim 9 further comprising a second spacer sandwiched between the bottom cover and the blade and having a second extension hole in communication with the through hole of the blade, a third indent defined in a periphery defining the second extension hole to be in communication with the first limiting notch and a fourth indent defined in the periphery defining the second extension hole to be in communication with the second limiting notch.

15. The safety clasp knife as claimed in claim 10 further comprising a second spacer sandwiched between the bottom cover and the blade and having a second extension hole in communication with the through hole of the blade, a third indent defined in a periphery defining the second extension hole to be in communication with the first limiting notch and a fourth indent defined in the periphery defining the second extension hole to be in communication with the second limiting notch.

* * * * *